United States Patent [19]

Stern

[11] Patent Number: 4,610,039

[45] Date of Patent: Sep. 9, 1986

[54] WASTE CONTAINER

[76] Inventor: Leif E. Stern, Fattershus, S-225 90 Lund, Sweden

[21] Appl. No.: 692,406

[22] Filed: Jan. 17, 1985

[30] Foreign Application Priority Data

Jan. 20, 1984 [SE] Sweden ..... 8400265

[51] Int. Cl.[4] ..... A61J 19/00

[52] U.S. Cl. ..... 4/285; 4/144.2; 141/390; 248/99; 220/404; 383/70

[58] Field of Search ..... 4/144.2, 258, 274, 285; 141/10, 316, 390–391; 248/95, 99, 101; 128/DIG. 24; 604/322–323, 338–339; 383/70; 220/404

[56] References Cited

U.S. PATENT DOCUMENTS

| | | | |
|---|---|---|---|
| 907,875 | 12/1908 | Pritchard | 4/274 |
| 2,036,687 | 4/1936 | Fisher | 383/70 |
| 2,734,198 | 2/1956 | Kutsche | 4/144.3 |
| 2,943,660 | 7/1960 | Seeger | 220/404 |
| 3,334,805 | 8/1967 | Halbach | 383/70 |
| 3,432,863 | 3/1969 | Schwartz | 4/484 |
| 3,643,266 | 2/1972 | Black . | |
| 3,693,192 | 9/1972 | Knotts | 4/484 |
| 3,920,179 | 11/1975 | Hall | 4/144.2 |
| 4,482,116 | 11/1984 | Vadnais | 141/390 |

FOREIGN PATENT DOCUMENTS

| | | | |
|---|---|---|---|
| 1426769 | 10/1969 | Sweden . | |
| 1578169 | 11/1969 | Sweden . | |
| 1088414 | 10/1967 | United Kingdom | 383/70 |

*Primary Examiner*—Stephen Marcus
*Assistant Examiner*—Linda J. Sholl
*Attorney, Agent, or Firm*—Schwartz, Jeffery, Schwaab, Mack, Blumenthal & Evans

[57] ABSTRACT

This invention relates to a waste container to be held in the hand for the collection of liquid waste, primarily stomach contents thrown up at attacks of vomiting. With a view to providing a waste container in which it is possible to catch large quantities of vomit or waste, which is readily handled without spillage of the contents, and which after deposition on a support prevents all by itself the contents and the smell from escaping, the waste container (1) comprises an annular handle (2) on which there is disposed a waste bag (3) whose length (L) considerably exceeds the diameter (D) of the annular handle (2), the waste bag (3) being flexible so as to bend at the annular handle (2) when the waste container (1) is deposited on a support to place a part (3*b*) of the waste bag (3) in recumbent position beside the annular handle (2), wholly or partly closed by the handle.

9 Claims, 11 Drawing Figures

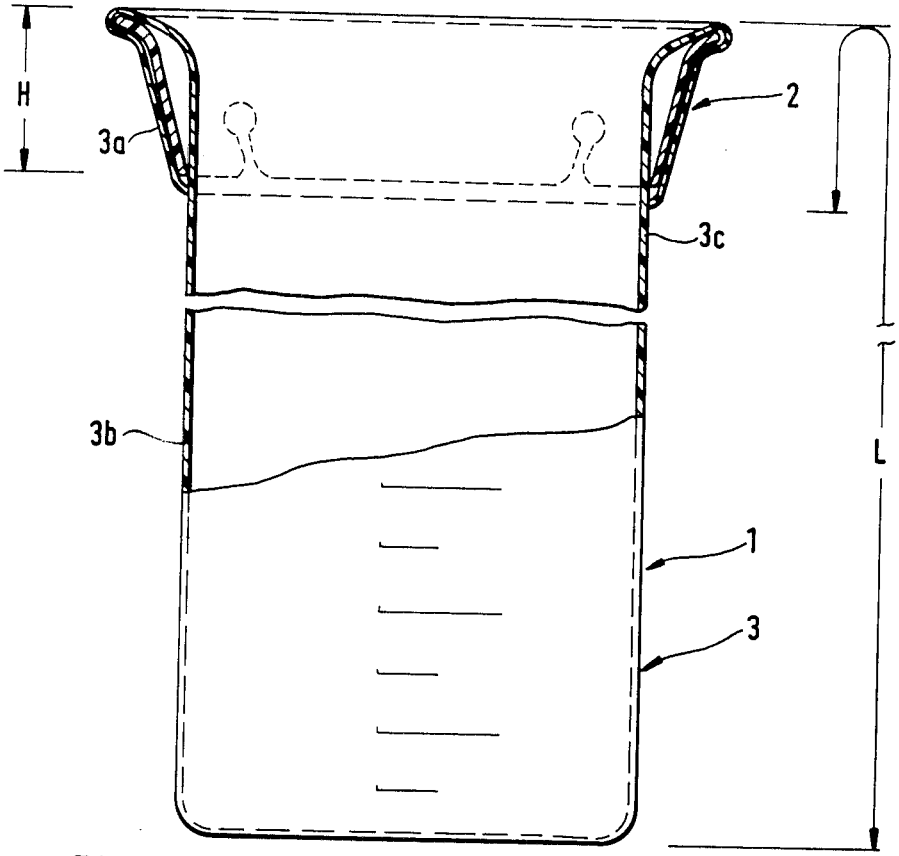
FIG. 1
FIG. 2
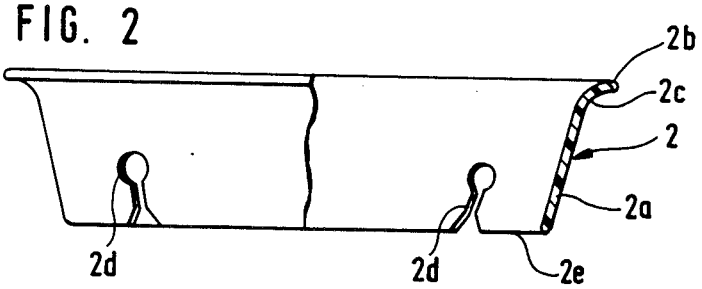

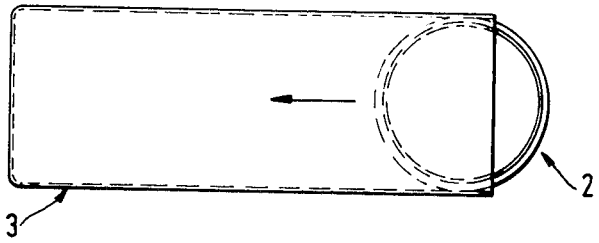
FIG. 3
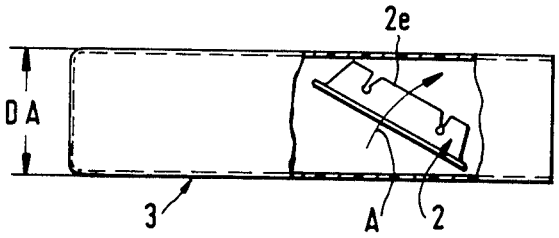
FIG. 4
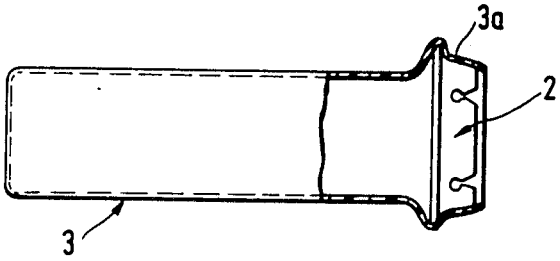
FIG. 5
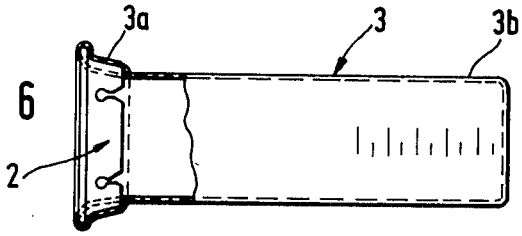
FIG. 6
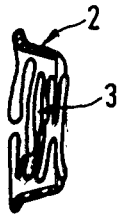
FIG. 7
FIG. 8
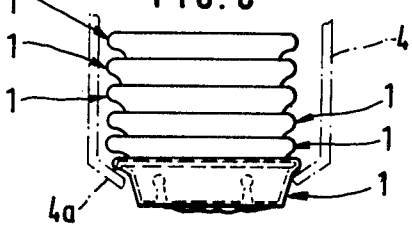

WASTE CONTAINER

This invention relates to a waste container to be held in the hand for the collection of liquid waste, primarily stomach contents thrown up at attacks of vomiting.

Usually, so-called kidney dishes serve as waste containers or receptacles for the collection of stomach contents. For practical reasons, prior art kidney dishes have a low rim, which is disadvantageous in some respects. Thus it is difficult not to spill the thrown-up stomach contents from the kidney dish when one holds the dish in one's hand during vomiting or when one moves the dish to a bedside table.

Another disadvantage of prior art kidney dishes is that one cannot prevent the smell of the vomit contained therein from spreading since the receptacle is not of a closable type. This smell is so unpleasant that it may give rise to a feeling of sickness in other patients.

A further disadvantage of prior art kidney dishes is that they usually are too small to hold a sufficient quantity. It is true that there also are big kidney dishes, but these are very unwieldy and are therefore but rarely used.

The object of the present invention is to overcome these problems and to provide a waste container in which one can catch large quantities of vomit or waste, which is easily handled without spillage of the contents and which after deposition on a support prevents all by itself the contents and the smell from escaping. According to the invention, this is realized by means of the characteristic features defined by the appendant claim 1.

The waste container according to the invention permits being held close to the mouth for collecting such quantities of stomach contents as normally occur, without any need of observing exactly how the container is inclined. When vomiting has ceased the container can be moved aside without fearing that the contents are spilt, and the container can be placed on a table in a rather careless way without risking that the contents or the smell will escape.

The invention shall be described more in detail in the following with reference to the accompanying drawings in which:

FIG. 1 is a side view, partly in section, of the waste container according to the invention;

FIG. 2 is a side view, partly in section, of a rim or annular member being part of the waste container;

FIG. 3 is a plan view illustrating how a rim or an annular member is introduced into a bag for the formation of the waste container shown in FIG. 1;

FIG. 4 is a side view illustrating how the rim or annular member is turned after its insertion in the bag;

FIG. 5 is a side view illustrating how the rim or annular member has been turned and has expanded the bag;

FIG.6 is a side view illustrating how the bag has been passed through the rim or annular member for providing a finished waste container;

FIG. 7 is a section illustrating how the bag has been folded together and placed within the rim or annular member;

FIG. 8 is a side view illustrating a number of waste containers placed in a holder or dispenser;

Figure 9:
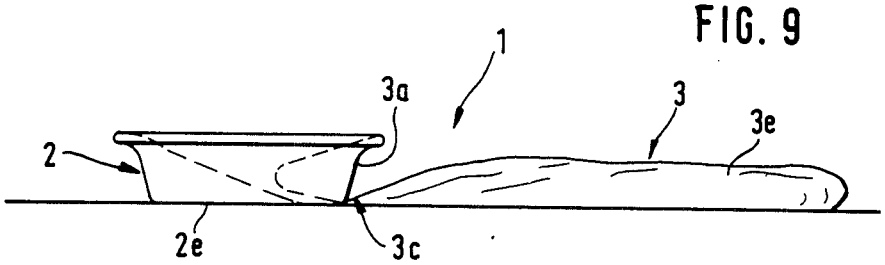
FIG. 9 is a side view of a waste container with contents which has been deposited on a support.

The waste container 1 illustrated in the drawings is intended for the collection of such stomach contents as are thrown up at attacks of vomiting. The waste container 1 substantially comprises an annular or tubular rim or handle 2, and a waste bag 3 disposed thereon. The annular rim or handle 2 is circular and presents a substantially axially extending portion 2*a*, and a substantially radially extending portion 2*b* connecting thereonto. The axially extending portion 2*a* conically tapers towards its free edge and merges via a rounded portion 2*c* in the substantially radially extending portion 2*b*. This design will make the annular handle easy and convenient to grasp, either it is held by the radially extending portion 2*b* with the thumb and index finger, or it is grasped by the axially extending portion 2*a*. Besides, the radially extending portion 2*b* constitutes a reinforcing portion that increases the stability of the handle and a suspension member that permits suspension of the handle in a dispenser 4 (see FIG. 8) from which the bag-type waste container 1 can be withdrawn by downward pull. The annular handle 2 and/or the lower portion 4*a* of the dispenser possesses such an elasticity that a withdrawal of the bag-type waste container 1 is possible.

The annular handle 2 is of a height of more than one-sixth of its diameter D, the height H being preferably about one-fourth of the diameter D of the annular handle 2. Said design of the annular handle 2 implies that it effectively prevents waste from escaping when the waste container 1 with its contents is deposited on a support. It is besides attained that the waste bag 3 in a folded-together state is accommodated within the annular handle 2 (see FIG. 7).

The described design gives the annular handle 2 such a rigidity that it substantially retains its shape when held in the hand and when carrying the weight of a more or less full waste bag 3. The diameter D of the annular handle 2 of course is so large that one can readily catch the stomach contents when vomiting. The handle 2 is preferably made from plastics material and it is slightly elastic and has rounded edges in order not to damage the waste bag 3. The axially extending portion 2*a* of the handle 2 presents one or more recesses 2*d* in which laterally directed parts of the waste bag in a folded-together or twisted-together state can be inserted, as will be demonstrated in the following:

The waste bag 3 is of a length L essentially in excess of the diameter D of the annular handle 2. Such a waste bag 3 will hold a sufficient quantity of waste to permit being used for the collection of stomach contents, and it can form a part 3*b* which with the contents therein can place itself beside the annular handle 2 when the waste container 1 is deposited on a support (see FIG. 9). The waste bag 3 is so flexible that it can bend at the annular handle 2 as the waste bag 3 engages the support at the deposition of the waste container 1 on said support. If the movement of depositing the waste container 1 on the support is continued the waste bag 3 will finally fully engage the support with the annular handle 2 lying on one side, with the opening of the handle facing upwardly. By then pressing the annular handle 2 downward the laterally directed part 3*b* of the waste bag 3 is compressed by the lower edge 2*e* of the annular handle 2, whereby the part 3*b* with its contents is wholly or partly closed depending upon the degree of the pressure exerted. It is shown in FIG. 9 how the part 3*c* of the waste bag has been throttled by the annular handle 2 being pressed down against it. Waste is hereby prevented from flowing out and/or smell from escaping from the part 3*b*. Even though there is no complete throttling of the part 3*c* and a small opening remains, at least part of the waste is prevented from flowing out and part of the smell from escaping, which is fully sufficient in many cases.

As can be seen in FIG. 9, the waste bag 3 is attached to the upper edge of the handle 2 and extends downwardly through the handle and past the lower edge 2*e* of the handle 2. The handle 2 has a predetermined diameter and height so that when the waste bag is closed by depressing the lower edge 2*e* of the handle 2 against the waste bag 3 as shown in FIG. 9, an upper edge of the waste bag (shown in phantom) extends diagonally across the handle from the upper edge to the lower edge.

Figure 10:
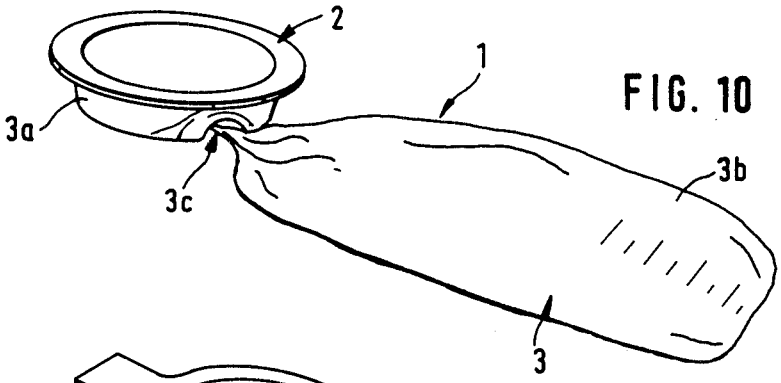
FIG. 10 is a perspective view of a waste container with contents which has been closed with the aid of the rim or annular member.
Figure 11:
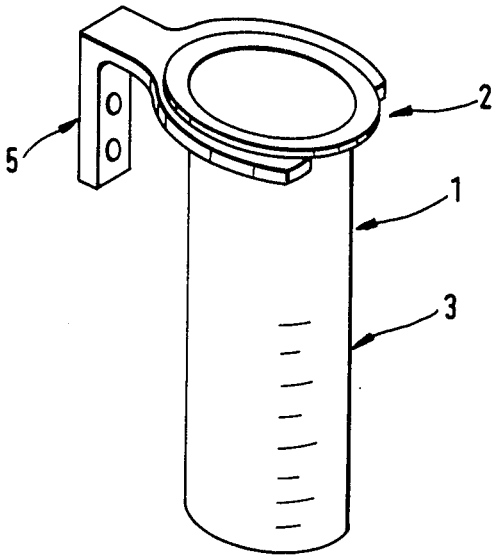
FIG. 11 is a perspective view of the waste container mounted on a bracket.

By reason of its height the annular handle 2 further constitutes a "trough" which prevents the waste from escaping if the waste bag 3 is well filled and there is no complete throttling. In this case, the waste can flow out into said "trough" up to the upper edge of the annular handle before it flows over. This will further reduce the risk of waste escaping from the waste container 1 upon deposition thereof, even though it contains considerable quantities of waste. As will appear from FIG. 10 one can, in combination with the throttling of the part 3*b*, by a simple compression of the waste bag 3, or as an alternative of said throttling, throttle the waste bag 3 by twisting it until a complete tight throttling of the part 3*c* has been realized in that said part has been rolled together completely. This rolled-together part 3*c* is then inserted in one of the recesses 2*d* of the annular handle 2, whereby said part is prevented from opening. This produces a more efficient closure of the waste container 1 and may be applied whenever the patient is able to carry out a more complicated sealing operation instead of only putting down the waste container 1 and compressing it by means of the annular handle 2, as shown in FIG. 9.

The outer diameter D of the annular handle 2 is so chosen that the handle 2 can be moved into the waste bag 3 when the latter is flattened in the manner appearing from FIG. 3. Having been fully inserted in the waste bag 3, the handle 2 is turned (arrow A in FIG. 4) with its lower edge 2*e* directed out of the waste bag 3. The waste bag 3 in its expanded state has a smaller diameter DA than the outer diameter D of the handle, which means that the waste bag 3 will be expanded and remain fastened around the handle when the latter has been turned to a position transverse to the longitudinal axis of the waste bag 3 (see FIG. 5). The radial portion 2*b* of the annular handle 2 will contribute to a reliable retention of the waste bag 3 to the handle 2. Finally, the waste bag 3 is passed through the annular handle 2 so that the end part 3*a* of the waste bag 3 surrounds the annular handle 2 and is fastened to it, whereafter the waste bag 3 extends through the annular handle 2 without any part thereof being connected to the inner portion of the annular handle 2. This implies that the waste bag 3 proper does not prevent the folding thereof when it is deposited on a support in the manner appearing from FIG. 9.

For hygienic reasons, it may sometimes be advantageous to have the part 3*a* of the waste bag 3 cover the entire annular handle 2 from outside so that one does not come in direct contact with the annular handle 2 when one holds it. The annular handle 2 and the waste bag 3 being separate parts, it is possible to reuse the handle 2 whereas the waste bag 3 with its contents is discarded, whereupon the annular handle 2 is provided with a new waste bag 3. Before the waste bag 3 is discarded after being loosened from the handle, the bag may be closed by tying up its open portion. As an alternative, the annular handle 2 and the waste bag 3 can be discarded together, in which case the waste bag 3 may be closed by means of the annular handle in the manner appearing from FIG. 10.

As will be apparent from the aforesaid, the gist of the invention resides in that one can effectively collect primarily stomach contents, that one does not spill said contents even if the waste container 1 is incautiously handled and that the waste and the smell thereof do not escape when the container 1 has been put aside. The features necessary herefor will appear from the above description and the drawings, and the other detail embodiments of the various parts of the waste container according to the invention are suitable but not necessary. As for detail embodiments of the annular handle it may, however, be mentioned that said handle preferably consists of plastics material, that it may have a shape other than circular, that it may be designed otherwise than with an axial and a radial portion, that it may have a height and a diameter other than those indicated and illustrated even though the embodiment described and shown is specially suited if the waste container is utilized for the collection of stomach contents.

The waste bag 3 may consist of a soft elastic tubular blank of uniform thickness, which is sealed at one end. However, it need not necessarily be of uniform thickness but can have any suitable form and it need not either necessarily consist of a tubular blank.

The waste bag 3 may be fixedly arranged on the annular handle 2 instead of being removably attached thereto, and the waste container as a whole may be used for collecting other waste than stomach contents at attacks of vomiting. For instance, the waste container 1 may be disposed on a bracket 5 which is mounted on a wall or on any other suitable unit beside a sickbed or at any other place. As a result, one need not hold the waste container 1 in one's hand when vomiting or when one puts other waste thereinto. Once this has been made it may be deposited in the manner indicated on a support for closure.

To permit measuring the degree of filling the waste container 1 may be of transparent material and provided with graduations at one or more points.

I claim:

1. A hand-held waste container for collecting vomit and the like, said waste container comprising:

a tubular rim having an upper edge and a lower edge;

a waste bag attached to said upper edge of said tubular rim, and extending downwardly through said tubular rim and past said lower edge, said waste bag being kept open by tubular rim;

said tubular rim being dimensioned such that when said waste bag is closed by depressing said lower edge against said waste bag when said waste container is deposited on a support, then an upper portion of said waste bag extends diagonally across said tubular rim from said upper edge to said lower edge.

2. The waste container of claim 1, wherein said rim is annular and has a height H and a width W, H being between at least one-sixth W and approximately one-fourth W, so as to prevent the stomach contents from spilling out of said container when said waste bag extends laterally from said rim.

3. The waste container of claim 1, wherein said rim and said waste bag are separate, interconnectible parts.

4. The waste container of claim 1, wherein said rim has at least one recess for accommodating a folded together portion of said waste bag.

5. The waste container of claim 1, wherein said waste bag comprises an elastic tubular blank of uniform thickness, closed at one end and closable at another end.

6. The waste container of claim 1, wherein said opening is a central opening.

7. The waste container of claim 1, wherein said rim is annular.

8. The waste container of claim 7, wherein said annular rim comprises a substantially axially extending portion and a substantially radially extending portion connecting thereonto.

9. A method for collecting vomit and the like comprising:

(a) attaching a waste bag to a tubular rim having an upper edge and a lower edge;

(b) attaching said waste bag to said upper edge of said tubular rim and extending downwardly through said tubular rim and past said lower edge, said waste bag being kept open by said tubular rim;

(c) depositing said waste bag and said rim on a support, such that a portion of said waste bag extends laterally from said rim;

(d) closing said waste bag by depressing said lower edge against said laterally extending portion of said waste bag which extends diagonally across said tubular rim from said upper edge to said lower edge.

* * * * *